US006955192B2

(12) United States Patent
Matsui et al.

(10) Patent No.: US 6,955,192 B2
(45) Date of Patent: Oct. 18, 2005

(54) VEHICLE RUNNING ASSISTING FABRIC

(75) Inventors: Yasuaki Matsui, Tokyo (JP); Shinji Ohara, Tokyo (JP); Takehito Kuji, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 407 days.

(21) Appl. No.: 10/067,213

(22) Filed: Feb. 7, 2002

(65) Prior Publication Data

US 2002/0148525 A1 Oct. 17, 2002

(30) Foreign Application Priority Data

Feb. 13, 2001 (JP) ..... 2001-077198

(51) Int. Cl.[7] ..... D03D 11/00

(52) U.S. Cl. ..... 139/384 R; 139/386; 139/408; 139/411; 139/416; 139/DIG. 1; 139/383 A; 442/203; 442/205; 442/206; 442/207

(58) Field of Search ..... 139/384 R, 386, 139/385.5, 383 R, 408, 411, 416, 383 A, DIG. 1; 442/203, 205, 206, 207

(56) References Cited

U.S. PATENT DOCUMENTS 1,512,286 A * 10/1924 Horton ..... 28/158
1,998,041 A * 4/1935 Barbet ..... 139/384 R
2,190,053 A * 2/1940 Amyot ..... 139/384 R
2,424,771 A * 7/1947 Preneta ..... 139/384 R
2,424,928 A * 7/1947 Glendinning et al. ... 139/384 R
2,681,223 A * 6/1954 Walters et al. ..... 267/47
5,021,283 A * 6/1991 Takenaka et al. ..... 428/116
5,501,891 A * 3/1996 Saika et al. ..... 428/71
5,846,890 A * 12/1998 Deschamps ..... 442/203

* cited by examiner

*Primary Examiner*—John J. Calvert
*Assistant Examiner*—Robert H. Muromoto, Jr.
(74) *Attorney, Agent, or Firm*—Rader, Fishman & Grauer PLLC

(57) ABSTRACT

In a fabric to assist a vehicle to run in the presence of snow, sand, or mud, or in an unleveled land, a core fabric is formed by weaving the weft and the warp. An upper convexity warp which is disposed over the core fabric forming warp and is woven with an upper convexity weft disposed on the core fabric forming weft, and/or a lower convexity warp which is disposed under the core fabric forming warp and is woven with a lower convexity weft disposed under the core fabric forming weft, to form a convexity. The upper or lower convexity warp is woven with one or plurality of the core fabric forming wefts to form a woven portion.

10 Claims, 8 Drawing Sheets

FIG. 2

| | 1′ | 2′ | 3′ | 4′ | 5′ | 6′ | 7′ | 8′ |
|---|---|---|---|---|---|---|---|---|
| 50 | | × | | | | | | |
| 49 | | × | | | | × | × | |
| 48 | × | × | × | | | × | × | |
| 47 | | | | | | × | | |
| 46 | | × | × | | | × | | |
| 45 | | × | × | × | × | × | × | × |
| 44 | | × | | | | | | |
| 43 | × | × | × | | | × | × | |
| 42 | | | | | | × | | |
| 41 | | × | × | | × | × | × | |
| 40 | × | × | | | | × | | |
| 39 | | × | × | | × | × | × | |
| 38 | × | × | × | × | × | × | × | |
| 37 | × | × | | | | × | | |
| 36 | × | × | × | | × | × | × | × |
| 35 | | × | | | × | × | | |
| 34 | × | × | | | × | × | × | |
| 33 | × | × | × | × | × | × | × | |
| 32 | × | | | | | | | |
| 31 | × | × | × | | × | × | | |
| 30 | × | × | × | | × | × | × | × |
| 29 | | × | | | × | × | | |
| 28 | × | × | | | × | × | × | |
| 27 | × | × | × | × | × | × | × | |
| 26 | × | | | | | | | |
| 25 | × | × | × | | × | × | | |
| 24 | × | × | × | | × | × | × | × |
| 23 | | × | | | × | × | | |
| 22 | × | × | | | × | × | × | |
| 21 | × | × | × | × | × | × | × | |
| 20 | × | | | | | | | |
| 19 | × | × | × | | × | × | × | × |
| 18 | | × | | | × | × | | |
| 17 | × | × | × | × | × | × | × | |
| 16 | × | × | | | | × | | |
| 15 | | × | × | | × | × | × | |
| 14 | × | × | | | | × | | |
| 13 | | | | | | × | | |
| 12 | | × | × | | × | × | × | |
| 11 | | × | | | | | | |
| 10 | × | × | × | | | × | × | |
| 9 | | | | | | × | | |
| 8 | | × | × | | | × | | |
| 7 | | × | × | × | × | × | × | × |
| 6 | | × | | | | | | |
| 5 | | × | | | | × | × | |
| 4 | × | × | × | | | × | × | |
| 3 | | | | | | × | | |
| 2 | | × | × | | | × | | |
| 1 | | × | × | × | × | × | × | × |

FIG. 12

| | 1′ | 2′ | 3′ | 4′ | 5′ | 6′ | 7′ | 8′ |
|---|---|---|---|---|---|---|---|---|
| 46 | | × | | | | | | |
| 45 | | × | × | | | × | | |
| 44 | × | × | × | | | × | × | |
| 43 | | | | | | × | | |
| 42 | | × | | | | × | × | |
| 41 | | × | × | × | × | × | × | × |
| 40 | | × | | | | | | |
| 39 | × | × | × | | | × | × | |
| 38 | | | | | | × | | |
| 37 | | × | × | | × | × | × | |
| 36 | × | × | | | | × | | |
| 35 | | × | × | | × | × | × | |
| 34 | × | × | × | × | × | × | × | |
| 33 | × | × | | | | × | | |
| 32 | × | × | × | | × | × | × | × |
| 31 | | × | | | × | × | | |
| 30 | × | × | × | | × | × | | |
| 29 | × | × | × | × | × | × | × | |
| 28 | × | | | | | | | |
| 27 | × | × | | | × | × | × | |
| 26 | × | × | × | | × | × | × | × |
| 25 | | × | | | × | × | | |
| 24 | × | | × | × | | | × | × |
| 23 | × | × | | | × | × | × | |
| 22 | × | × | × | | × | × | × | × |
| 21 | | × | | | × | × | | |
| 20 | × | × | × | | × | × | | |
| 19 | × | × | × | × | × | × | × | |
| 18 | × | | | | | | | |
| 17 | × | × | × | | × | × | × | × |
| 16 | | × | | | × | × | | |
| 15 | × | × | × | × | × | × | × | |
| 14 | × | × | | | | × | | |
| 13 | | × | × | | × | × | × | |
| 12 | × | × | | | | × | | |
| 11 | | | | | | × | | |
| 10 | | × | × | | × | × | × | |
| 9 | | × | | | | | | |
| 8 | × | × | × | | | × | × | |
| 7 | | | | | | × | | |
| 6 | | × | | | | × | × | |
| 5 | | × | × | × | × | × | × | × |
| 4 | | × | | | | | | |
| 3 | | × | × | | | × | | |
| 2 | × | × | × | | | × | × | |
| 1 | | | | × | × | | | × |

VEHICLE RUNNING ASSISTING FABRIC

BACKGROUND OF THE INVENTION

The present invention relates to a fabric which assists a vehicle including an automobile to run in the presence of snow, sand, or mud or in an insufficiently leveled or unleveled ground, which recovers an overrun airplane, which assists a hovercraft to make a landing in an island, which is disposed in an insufficiently leveled temporary road or parking lot in the presence of snow, sand, or mud to assist the vehicle to run, which is used as a temporary heliport to assist the airplane to run, or conversely which is disposed in a leveled road to prevent the road, and the like from being damaged by the running of a heavy vehicle, or the like.

When a vehicle runs in a place with snow, sand, or mud present therein, tires are caught by the sand, or slip, thereby frequently resulting in a running disable situation. In this situation, even when the tires are rotated, the ground is further dug and it becomes further difficult to escape. Moreover, a heavy vehicle or a heavily loaded vehicle is easily caught and has further difficulty in escaping. There has been a strong demand for solving the problem.

To prevent this situation from occurring, or as an escape measure if the situation occurs, a steel plate or an aluminum plate has heretofore been laid temporarily on a sandy soil. However, the metal plate is heavy in weight, much labor is required in handling the plate, or a size of one plate is limited from a problem of storage or transport. It has taken much time and labor to fill the running road with the plates.

Additionally, a rubber sheet constituted of a steel iron rope as a core has been used, but is very heavy and is disadvantageously handled with difficulty.

Moreover, a fabric woven with a synthetic resin fiber has also been used, but a fabric design obtained simply by weaving warps and wefts has a flat structure. Therefore, the tires slip or the fabric slips on a contact ground surface and a desired effect cannot be obtained. It has also been proposed to dispose protrusions in the fabric or the rubber sheet in order to prevent the slipping. However, the number of manufacturing steps increases, the protrusions are frequently broken or removed during use, and there are too many problems in practical use.

It has also been considered to use synthetic resin yarns and weave a fabric having concavities/convexities. However, the fabric does not have a woven structure sufficient in rigidity and concavities/convexities, and it is impossible to obtain a fabric which produces a desired effect required for an escape assisting fabric for the vehicle.

SUMMARY OF THE INVENTION

According to the present invention, there is provided a running assistance fabric for a vehicle, which comprises a woven structure obtained by weaving yarns and formed in a concavity/convexity shape to provide a sufficient rigidity and a sufficient effect of slip resistance, which is lightweight and easy to handle, and which can be spread in a target unleveled ground in a short time, wound up, and stored.

The present invention relates to a vehicle running assistance fabric having a convexity by a woven structure for a vehicle, wherein a warp forming a core fabric and a weft forming the core fabric are arranged; the core fabric is formed by weaving the weft and the warp; an upper convexity warp is disposed over the core fabric forming warp and an upper convexity weft is disposed over the core fabric forming weft and/or a lower convexity warp is disposed under the core fabric forming warp and a lower convexity weft is disposed under the core fabric forming weft, and woven respectively; and the convexity warps are woven with the one or plurality of core fabric forming wefts to form a woven part.

The upper convexity and the lower convexity may be displaced and arranged into different positions via the core fabric.

Further, the convexity warps are disposed over or under the core fabric forming warp, and may be a single-layer warp woven with both the upper and lower convexity wefts. Alternatively, the convexity warps are disposed over and under the core fabric forming warp, the upper convexity warp may be woven with the upper convexity weft disposed over the core fabric forming weft and may be woven partially with the core fabric forming weft, and the lower convexity warp may be woven with the lower weft disposed under the core fabric forming weft and may be woven partially with the core fabric forming weft.

Further, an outermost disposed warp among a plurality of the upper and lower convexity warps may be woven with the upper convexity weft or the lower convexity weft and the core fabric forming weft, and at least one of the warps arranged inside the outermost disposed warp may be woven with both the upper and lower convexity wefts and with the core fabric weft. Alternatively, an outermost disposed warp among a plurality of the upper and lower convexity warps may be woven with the upper convexity weft or the lower convexity weft, and each of the warps disposed inside the outermost disposed warp may be woven with one of the upper convexity weft and the lower convexity weft.

BRIEF EXPLANATION OF THE DRAWINGS

FIG. 2 is a design diagram of the running assistance fabric of FIG. 1.

FIG. 12 is a design diagram of the running assistance fabric of FIG. 11.

PREFERRED EMBODIMENTS OF THE INVENTION

Figure 1:
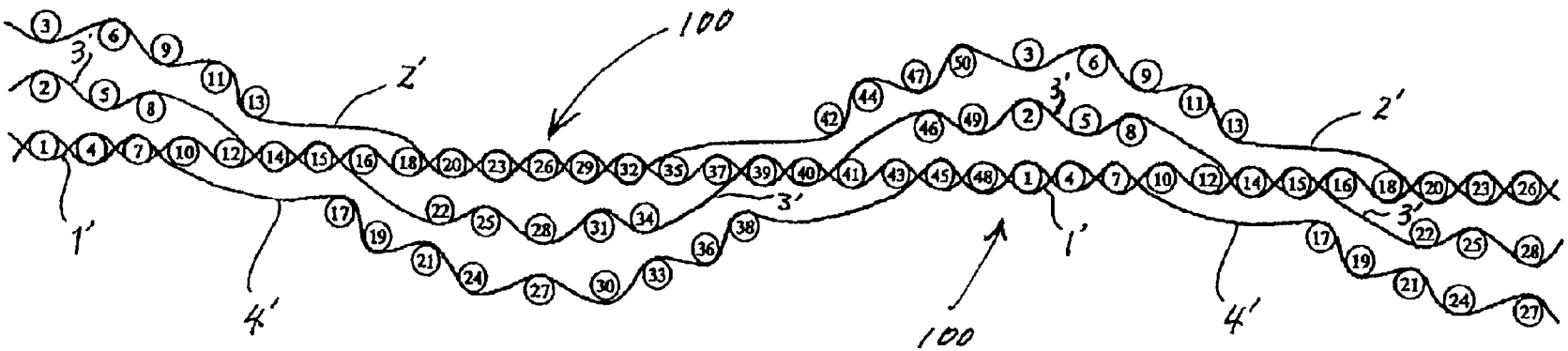
FIG. 1 is a sectional view of a running assistance fabric for a vehicle according to Example 1 of the present invention.

In the fabric of the present invention, the convexity shape is formed on a woven structure. Therefore, even when a vehicle runs on an unleveled ground with the fabric attached thereto, the convexity shape is not removed or destroyed. Even when the vehicle runs in a place with snow, sand, or mud present therein, tires do not slip or are not caught. Moreover, since a fabric structure has a concavity/convexity shape, the concavity/convexity of the fabric bites into a contact surface, and the fabric does not deviate or protrude even with rotation of the tires. Since the fabric has a cushioning property, the fabric can be used to protect leveled roads.

Moreover, the fabric woven with yarns manufactured of a synthetic resin easily fits the shape of the ground. Furthermore, the fabric can advantageously be wound in a roll shape and stored in a compact shape during storage. Additionally, the sands which enter the fabric during use easily come out of meshes and therefore it is unnecessary to remove the sands. A light weight and ease of handling are also major characteristics.

In the present invention, a special fabric structure is used to constitute a fabric, which has the convexity shapes. The fabric design consists of a core fabric forming warp and a core fabric forming weft, which are woven and form a core fabric, a convexity warp, an upper convexity weft disposed on the core fabric, and a lower convexity weft disposed under the core fabric. There may be in some cases two types of warps for the convexities, namely, a warp which forms the upper convexity and a warp which forms the lower convexity. There may be in the other case one type of convexity warp which forms both upper convexity and the lower convexity.

Moreover, a woven portion may be formed by partially weaving the convexity warp with the core fabric forming weft.

Between the woven portions, the convexity warp is woven with the upper convexity weft on the core fabric to form the upper convexity, and is woven with the lower convexity weft under the core fabric to form the lower convexity so that the convexity shapes are constituted in the fabric.

As described above, the running assistance fabric of the present invention is a fabric having a multilayered structure including: the core fabric; and a large number of convexities formed by weaving the convexity warps with the convexity wefts on and under the core fabric.

The core fabric has a function of enhancing rigidity of the fabric, and also produces an effect of assisting the convexity shapes to be formed.

When the core fabric is woven with the convexity warp, the core fabric can be formed in the convexity shape. Particularly, it is unnecessary to bend the core fabric and form the convexity shapes. The convexity shapes may be constituted on a flat core fabric.

The core fabric forming a core of the fabric preferably has a high fabric strength, and may particularly have a plain weave in which the core fabric forming warp alternately passes over and under the core fabric forming weft.

The convexity weft includes the upper convexity weft disposed on the core fabric, and the lower convexity weft disposed under the core fabric. The convexity warp is woven with the convexity weft between the woven portions formed by partially weaving the warps for the convexities with the wefts for the core fabric. The convexity warp is woven with the upper convexity weft to form the upper convexity between the woven portions on the core fabric, and is woven with the lower convexity weft to form the lower convexity under the core fabric.

As described above, the convexity warp is woven with the convexity weft to form the upper convexity and lower convexity between the woven portions, and the fabric design of the convexity warp between the woven portions is preferably a plain weave fabric design similarly as the core fabric in order to enhance the fabric strength. Moreover, since the fabric of the present invention is formed by weaving the yarns of synthetic resins, the yarns easily slip in intersections of the yarns. When the number of weavings is increased as in the plain weave fabric design, slip of the yarn is effectively decreased. Therefore, the plain weave fabric design also preferably forms the stable fabric.

Moreover, the fabric design is not particularly limited even in the woven portion by the convexity warp and the core fabric forming weft. The number of core fabric forming wefts in the woven portion of the convexity warp with the core fabric forming weft, and the number of wefts for the convexity in the convexity formed by weaving the convexity warp with the convexity weft between the woven portions may also be determined in consideration of a weaving property and other conditions of the fabric.

As described above, the fabric of the present invention is constituted of the core fabric, the woven portion formed by weaving the convexity warps with some of the wefts for the core fabric, and the convexities formed by weaving the convexity warp with the convexity weft between the woven portions. In the present invention, the upper convexity may preferably deviate from the lower convexity in order to form a further sufficient fabric convexity. When the upper and lower convexities are displaced and arranged, the core fabric is bent and the sufficient convexities can be formed in the entire fabric. A method of forming the sufficient convexity will be described hereinafter.

In the fabric of the present invention, the core fabric is used as a base, the woven portion is formed by partially weaving the convexity warp with the core fabric forming weft, the upper convexity is formed by weaving the convexity warp with the convexity weft on the core fabric between the woven portions, and the lower convexity is formed by weaving the convexity warp with the lower convexity weft under the core fabric. The warps for the convexities are woven with the respective wefts with tensions, and a force is exerted in a direction in which the core fabric tries to contract between the woven portions. Therefore, the core fabric between the woven portions tries to bend upwards or downwards with respect to the core fabric. Moreover, in a portion in which the warp for the upper convexity forms the upper convexity on the core fabric, the core fabric between the woven portions easily protrudes on the core fabric. In a portion in which the warp for the lower convexity forms the lower convexity under the core fabric, the core fabric between the woven portions easily protrudes downwards with respect to the core fabric. Therefore, the woven portion of the warp for the upper convexity with the convexity weft on the core fabric, and the core fabric between the woven portions protrude upwards, and the woven portion of the warp for the lower convexity with the convexity weft under the core fabric, and the core fabric between the woven portions protrude downwards. When these are combined, the fabric having the convexity shape can be obtained.

The woven portion formed by weaving the warp for the upper convexity with the core fabric forming weft, and the woven portion formed by weaving the warp for the lower convexity with the core fabric forming weft are displaced, or arranged in the same position. In the latter case, that is, when the upper woven portion of the warp for the upper convexity and the lower woven portion of the warp for the lower convexity are woven with the same core fabric forming weft, the upper convexity is disposed opposite to the lower convexity via the core fabric, and the convexity is not sufficiently formed.

In the former case, that is, when the woven portion formed by weaving the convexity warps on both sides of the core fabric via the core fabric is displaced and disposed, the lower woven portion formed by weaving the warp for the lower convexity with the core fabric forming weft from under the core fabric via the core fabric is disposed between the woven portion of the warp for the upper convexity woven with the core fabric forming weft. Moreover, the upper woven portion formed by weaving the upper convexity warp with the core fabric forming weft from above the core fabric via the core fabric is disposed between the woven portion of the warp for the lower convexity woven with the core fabric. With the combination of the arrangement, the upper convexity between the portions woven by the upper convexity warps is pushed upwards from the lower side of the core fabric by the lower woven portion, and promotes formation of the upper convexity. Similarly, the woven portion of the warp for the lower convexity and the lower convexity weft under the core fabric between the woven portions by the lower convexity warp pushes the core fabric downwards from above the core fabric by the upper woven portion, and promotes formation of the lower convexity. The sufficient convexity shape is given to the fabric by repeating the fabric design unit. Moreover, the lower woven portion of the lower convexity warp woven with the core fabric forming weft is disposed right in a middle position of the upper convexity disposed on the core fabric so that the upper and lower convexities uniformly protrude. On the other hand, the upper woven portion of the upper convexity warp woven with the core fabric forming weft may be disposed right in the middle position of the lower convexity disposed under the fabric.

Moreover, a plurality of layers of upper convexity warps may be disposed in order to further enhance the strength of the fabric and stabilize the fabric design. Between the upper woven portions, one or several layers of warps for the upper convexity are woven with the core fabric forming weft in the lower woven portion formed by weaving the lower convexity warp disposed opposite to some of the upper convexity warps woven with the upper convexity weft substantially in a middle portion of the convexity via the core fabric with the core fabric forming weft, so that a woven portion for maintaining a posture is formed in the fabric design. Moreover, between the lower woven portions, one or several layers of lower convexity warps are woven with the core fabric forming weft in the woven portion formed by weaving the upper convexity warp disposed opposite to some of the lower convexity warps woven with the lower convexity weft substantially in the middle portion of the convexity via the core fabric with the core fabric forming weft, so that the woven portion for maintaining the posture is formed in the fabric design. Since the convexity warp between the woven portions is woven into the core fabric in the fabric design, a knuckle as an intersection of the yarns does not easily deviate and is stabled, and the fabric of the convexity shape superior in strength can be formed. In the posture maintaining woven portion, it is sufficient to weave the convexity warp with one or several core fabric forming wefts and it is unnecessary to weave the warp with many wefts as in the usual woven portion of the core fabric.

One convexity warp may also form the concavity/convexity without using two warps for the upper and lower convexities. In this case, the upper convexity formed by weaving one convexity warp with the upper convexity weft, the woven portion formed by weaving the warp with the core fabric, and the lower convexity formed by weaving the warp with the lower convexity weft disposed under the core fabric. In this case, there is an effect that the positions of the upper and lower convexities naturally deviate.

Moreover, there is a method of singly using one type of convexity warp woven only with the upper convexity weft disposed on the core fabric. Even the fabric has a sufficient convexity shape, and is therefore effective as the running assistance fabric.

Additionally, three types of warps may be used: the warp for the upper convexity; warp for the lower convexity, the warps for the upper and lower convexities and another convexity warp are woven with the upper convexity weft to form the upper convexity, subsequently woven with the core fabric to form the woven portion, and subsequently woven with the lower convexity weft disposed under the core fabric to form the lower convexity.

Also in the fabric formed by combining several warps for the convexity, the fabric design including the woven portion for holding a posture formed by weaving some of the warps for the upper convexity with the core fabric forming weft between the upper woven portions, the fabric design including the woven portion for holding a posture formed by weaving some of warps for the lower convexity with the core fabric forming weft between the lower woven portions, the upper convexity formed by weaving one convexity warp with the upper convexity weft, the woven portion woven with the core fabric, and the lower convexity formed by weaving the warp with the lower convexity weft disposed under the core fabric are arranged. For the yarns structured in this manner, similarly the posture maintaining woven portion is disposed in the same fabric forming weft in the warp for the upper convexity, and the woven portion for holding a posture is disposed in the same fabric forming weft also in the warp for the lower convexity. This is preferable with respect to stability.

The yarn for use in the present invention is not particularly limited, but the yarn is used in a sandy or muddy soil in many cases. Therefore, it is preferable to use a single monofilament, rather than to use a intertwined yarn formed by intertwining yarns. Moreover, examples of a usable sectional shape of the yarn include not only a circular form, but also rectangular shapes, a square shape, a star shape, an elliptical shape, a hollow shape, and the like. A material of the yarn can also freely be selected from polyester, nylon, polyphenylene sulfide, polyvinylidene fluoride, polypropylene, aramid, polyether ether ketone, polyethylene naphthalate, polytetrafluoroethylene, and the like. Of course, a copolymer yarn, or a yarn formed by blending various materials with the above-described materials in accordance with a purpose may be used.

In the fabric of the present invention, as described above, only for the yarns arranged in a longitudinal direction, there are the core fabric forming warp, the upper convexity warp which forms the upper convexity, the lower convexity warp which forms the lower convexity, and other warps which form the convexities. The respective yarns are arranged in predetermined fabric designs, and therefore a line shape and type can also be changed with each yarn. For example, a monofilament of polyester is used in the core fabric in order to enhance the strength, a polyamide monofilament having resistance to wear is used in the convexity warp, and in this manner the linear shape and type can appropriately be changed in accordance the structure of the fabric.

EXAMPLES

The present invention will next be described concretely in terms of examples.

Figure 11:
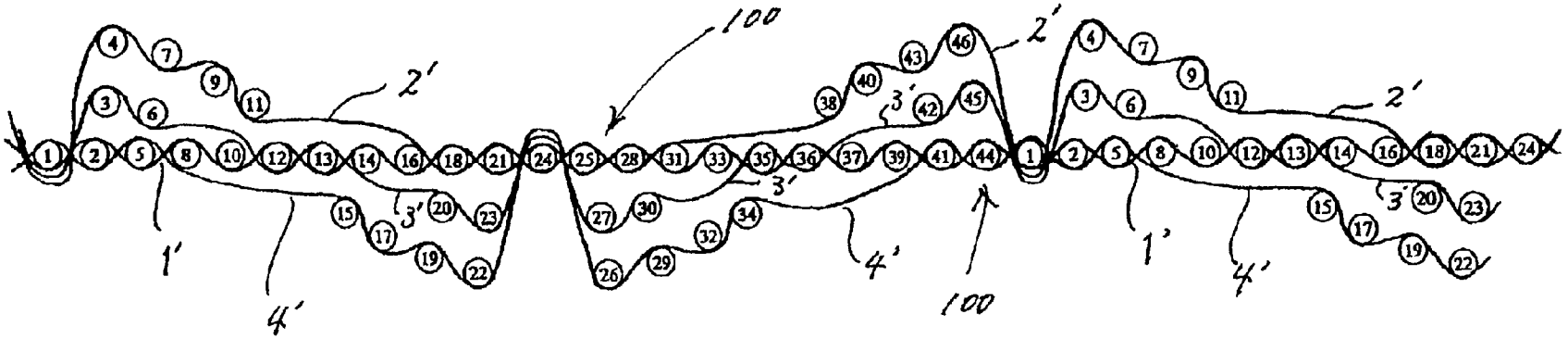
FIG. 11 is a sectional view of the running assistance fabric for the vehicle according to Example 2 of the present invention.

FIGS. 1 and 11 are sectional views of a running assistance fabric of the present invention. FIG. 2 shows a complete fabric design of the fabric of FIG. 1, and FIG. 12 shows a composition of the complete fabric design of the fabric of FIG. 11. The complete fabric design is a minimum repetition unit of the fabric design, and the fabric design of the whole fabric is formed by connecting upper, lower, left, and right complete fabric designs.

The sectional views of FIGS. 1 and 11 show only warps 1' to 4' for the sake of convenience, but an actual complete fabric design is constituted of eight warps shown in FIGS. 2 and 12. FIGS. 3 to 10 are sectional views of the warp of the fabric of FIG. 2, and FIGS. 13 to 20 are sectional views of the warp of the fabric of FIG. 12.

Moreover, the core fabric linearly extends in the present embodiment, but the embodiment also includes a fabric entirely formed in the convexity shape by bending the core fabric in accordance with the concavity/convexity of the fabric.

In the woven structure, the core fabric forming warp and the convexity warp are denoted with Arabic numerals with primes attached thereafter, such as 1', 2' and 3', and the wefts are denoted with Arabic numerals such as 1, 2 and 3.

Moreover, a cross mark X indicates that a warp is positioned on a weft.

Figure 3:
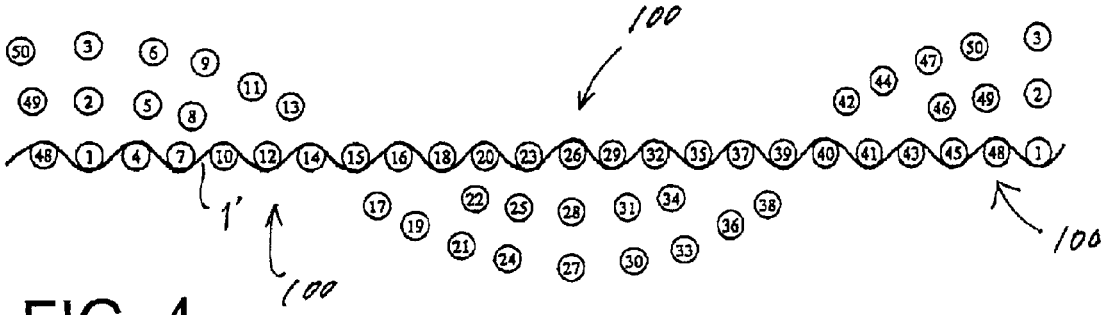
FIG. 3 is a sectional view taken along a core fabric forming warp 1' of the running assistance fabric of FIG. 1.
Figure 5:
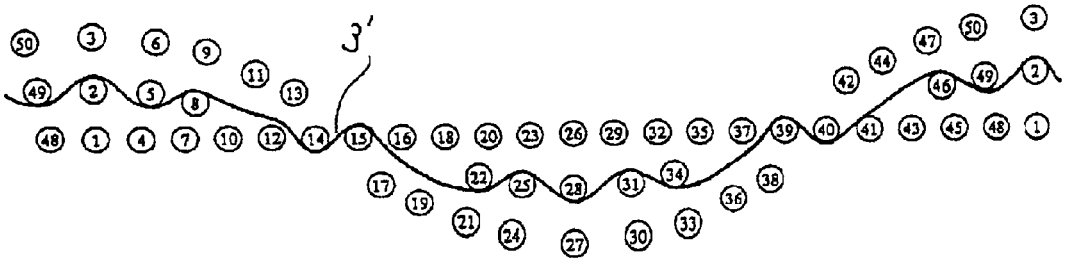
FIG. 5 is a sectional view taken along a convexity warp 3' of the running assistance fabric of FIG. 1.
Figure 6:
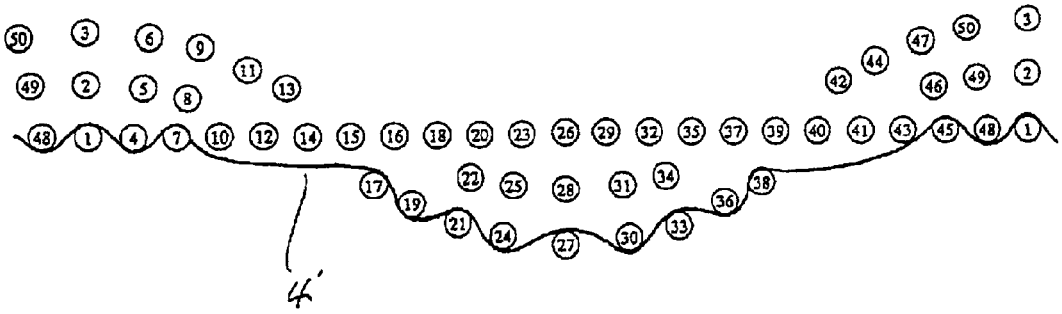
FIG. 6 is a sectional view taken along a convexity warp 4' of the running assistance fabric of FIG. 1.
Figure 7:
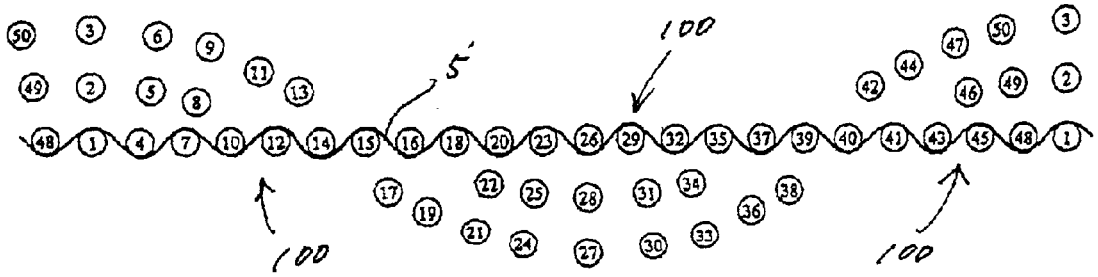
FIG. 7 is a sectional view taken along a core fabric forming warp 5' of the running assistance fabric of FIG. 1.

FIGS. 3 to 10 are sectional views of the fabric design in which the yarn in a warp direction constituting the running assistance fabric of Example 1 of the present invention shown in FIG. 2 is woven with the weft, FIGS. 3 and 7 are sectional views of the fabric design formed by intertwining the core fabric forming warp with the weft, and FIGS. 4, 5, 6, 8, 9 and 10 are sectional views of the convexity warp woven with the weft. FIGS. 13 to 20 are sectional views of the yarns in the warp direction which constitute the running assistance fabric of Example 2 of the present invention, FIGS. 13 to 17 are sectional views in which the core fabric forming warp is woven with the weft, and FIGS. 14, 15, 16, 18, 19 and 20 are sectional views in which the convexity warp is woven with the weft.

In the embodiment of the present invention, 1', 2', 3', 4', 5' and 6' denote the yarns in the warp direction, 1' and 4' denote warps forming the core fabric, and 2', 3', 5' and 6' denote the convexity warps. Moreover, for the weft, there are the core fabric forming weft and the convexity weft.

Example 1

The warps constituting the fabric of FIG. 2 are roughly divided in two types, one is the warp which forms the core fabric 100, and the other is the warp which forms the convexity on and under the core fabric 100. The warps forming the convexity are further divided into three types of warps for the convexity. The three types of warps for the convexity are used to form a multilayered structure so that the strength and rigidity are enhanced. In FIG. 2 the yarns in the warp direction include the warps for the core fabric 1', 5', warps for the upper convexity 2', 6', warps for the convexity 3', 7', and warps for the lower convexity 4', 8'. The wefts for the core fabric are 1, 4, 7, 10, 12, 14, 15, 16, 18, 20, 23, 26, 29, 32, 35, 37, 39, 40, 41, 43, 45 and 48, and wefts for the convexity are 2, 3, 5, 6, 8, 9, 11, 13, 17, 19, 21, 22, 24, 25, 27, 28, 30, 31, 33, 34, 36, 38, 42, 44, 46, 47, 49 and 50.

FIG. 1 shows a section obtained by cutting the fabric design of FIG. 2, the warp 1' constitutes a core fabric 100, and is woven with the wefts for the core fabric 1, 4, 7, 10, 12, 14, 15, 16, 18, 20, 23, 26, 29, 32, 35, 37, 39, 40, 41, 43, 45 and 48. The upper convexity warp 2' is woven with the wefts for the upper convexity 3, 6, 9, 11 and 13, subsequently woven with the core fabric forming wefts 20, 23, 26, 29 and 32 to form the woven portion, and again woven with the upper convexity wefts 42, 44, 47 and 50. The convexity warp 3' is woven with both the wefts for the upper convexity 2, 5, 8, 46, 49 and the wefts for the lower convexity 22, 25, 28, 31, 34. The warp for the lower convexity 4 is woven with the wefts for the lower convexity 17, 19, 21, 24, 27, 30, 33, 36, 38 and the wefts for the core fabric.

The example will concretely be described.

FIGS. 3 and 7 show a sectional fabric design in which the warp forming the core fabric 100 is woven with the weft. FIG. 3 shows the core fabric of a plain weave fabric design in which the core fabric forming warp 1' is disposed under the core fabric forming weft 1, continuously on the core fabric forming weft 4, . . . , and FIG. 7 shows the core fabric of the plain weave fabric design of one alternate weft in which the core fabric forming warp 5' is disposed on the core fabric forming weft 1, continuously under the core fabric forming weft 4, . . . In this manner, in the present example, two warps for the core fabric 1', 5' are disposed, or one or two or more warps for the core fabric may be disposed, and the fabric design is not limited to the plain weave. However, since the core fabric 100 is a portion forming the base of the fabric, the plain weave fabric is preferable from respects of strength, rigidity, and stability.

Figure 4:
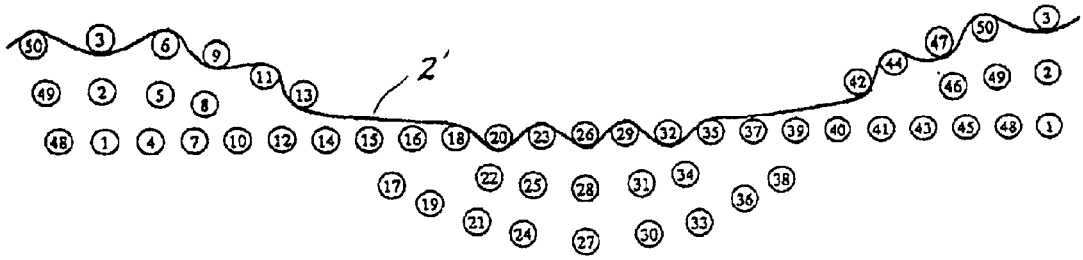
FIG. 4 is a sectional view taken along a warp for a convexity 2' of the running assistance fabric of FIG. 1.
Figure 8:
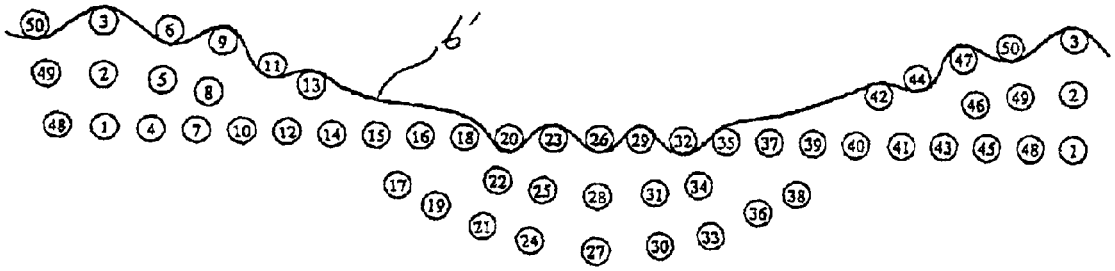
FIG. 8 is a sectional view taken along a convexity warp 6' of the running assistance fabric of FIG. 1.

FIGS. 4 and 8 show a sectional fabric design of the upper convexity warp. The convexity warp 2' shown in FIG. 4 is woven with the wefts for the upper convexity disposed above the wefts which form the core fabric, and further woven with several wefts forming the core fabric between the warps 1', 5' forming the core fabric so that the woven portion for forming the convexity is formed. The warp for the upper convexity 2' is woven with the upper convexity weft disposed on the core fabric, but the woven structure is not particularly limited. In the example, the warp 2' is woven with the convexity weft present over an outermost surface among the wefts for the upper convexity, and then passed under the convexity weft 42, over the convexity weft 44, under the convexity weft 47, over the convexity weft 50, under the weft for upper convexity 3, over the convexity weft 6, under the convexity weft 9, over the convexity weft 11, and under the convexity weft 13 to form the plain weave fabric design. Moreover, the fabric design in which all the warps for the convexity of the present invention are woven with the convexity weft and the number of woven wefts are not particularly limited. The fabric design of the woven portion for forming the convexity in which the warps are woven with several wefts forming the core fabric and the number of woven wefts are not particularly limited. The fabric design and the number of yarns can appropriately be changed as long as the weaving property is not troubled. For the fabric design, the plain weave fabric design is preferable in respects of strength and rigidity, but other fabric designs may be used.

Similarly, also in the warp for the upper convexity 6' shown in FIG. 8, the woven portion with the upper convexity weft disposed over the weft forming the core fabric, and the convexity forming woven portion with several wefts forming the core fabric between the warps forming the core fabric are present. The warp for the upper convexity 6' is woven with the convexity weft present on the outermost surface among the wefts for the upper convexity, and is passed over the convexity weft 42, under the convexity weft 44, over the convexity weft 47, under the convexity weft 50, over the convexity weft 3, under the convexity weft 6, over the convexity weft 9, under the convexity weft 11, and over the convexity weft 13 to form the plain weave fabric design. The warp for the upper convexity 2' is different from the warp for the upper convexity 6' in the fabric design of the woven portion with the upper convexity weft. This is the same plain weave fabric design, but an intertwining direction is vertically reversed in the plain weave fabric design. In this case, in the portion in which the convexity warp is woven with the convexity weft to form the convexity between the woven portions, two warps for the convexity having the reversed fabric design are combined and arranged, so that a stable fabric can be constituted.

Figure 10:
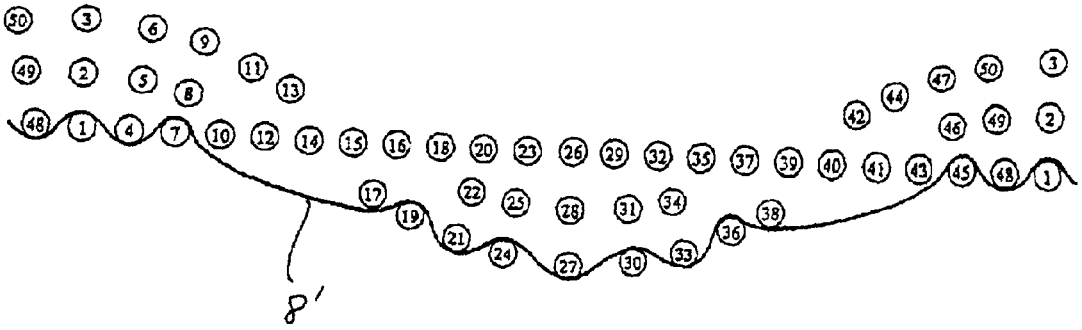
FIG. 10 is a sectional view taken along a convexity warp 8' of the running assistance fabric of FIG. 1.

FIGS. 6 and 10 show the sectional fabric design of the warp for the lower convexity. The warp for the lower convexity 4' shown in FIG. 6 is woven with the lower convexity weft disposed under the weft which forms the core fabric, and furthermore woven with several wefts forming the core fabric between the warps forming the core fabric to form the woven portion. The warp for the lower convexity 4' is woven with the lower convexity weft disposed under the core fabric, but the woven structure is not limited similarly as the warp for the upper convexity. Here, the warp 4' is woven with the convexity weft present on the outermost surface among the wefts for the lower convexity, and passed over the convexity weft 17, under the convexity weft 19, over the convexity weft 21, under the convexity weft 24, over the convexity weft 27, under the convexity weft 30, over the convexity weft 33, under the convexity weft 36, and over the convexity weft 38 to form the plain weave fabric design. Moreover, the fabric design of the woven portion formed by weaving the convexity warp with several wefts forming the core fabric and the number of woven wefts are not particularly limited.

Similarly, even in the lower convexity warp 8' shown in FIG. 10, the portion woven with the lower convexity weft disposed under the core fabric forming weft, and the woven portion woven with several core fabric forming wefts between the warps 1', 5' forming the core fabric are present. The convexity warp 8' is woven with the convexity weft present on the outermost surface among the wefts for the lower convexity, and is passed under the convexity weft 17, on the convexity weft 19, under the convexity weft 21, on the convexity weft 24, under the convexity weft 27, on the convexity weft 30, under the convexity weft 33, on the convexity weft 36, and under the convexity weft 38 to form the plain weave fabric design. The convexity warp 4 is different from the convexity warp 8' in the fabric design of the portion formed by weaving the convexity warp with the lower convexity weft. This is the same plain weave fabric design, but the intertwining direction is vertically reversed in the plain weave fabric design. In this case, in the portion in which the convexity warp is woven with the convexity weft to form the convexity between the woven portions, two warps for the convexity having the reversed fabric design are combined and arranged, so that the stable fabric can be constituted.

For the arrangement of the upper convexity warp design that forms the upper convexity and the lower convexity warp design that forms the lower convexity, the woven portion formed by weaving the lower convexity warp with several core fabric forming wefts is disposed under the portion in which the upper convexity warp is woven with the upper convexity weft. Then the fabric provides sufficient convexity in shape. Similarly, the woven portion formed by weaving the upper convexity warp with several core fabric forming wefts may be disposed over the portion in which the lower convexity warp is woven with the lower convexity weft.

Even the fabric constituted only of the above-described warps 1', 2', 4', 5', 6' and 8' can sufficiently function, but the satisfactory rigidity and strength can be secured in the multilayered fabric including the following warps 3', 7' as in the present example.

Figure 9:
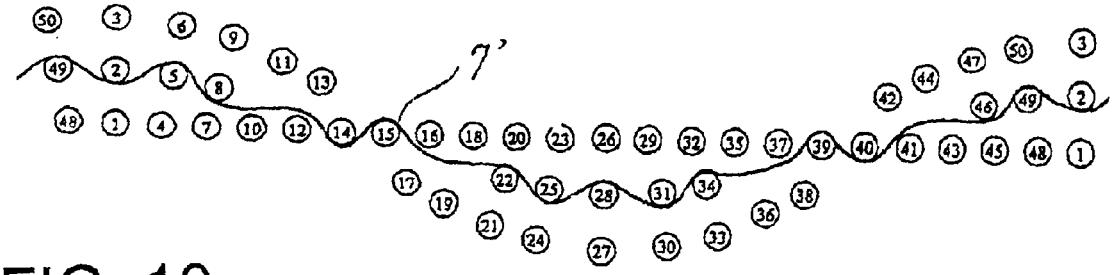
FIG. 9 is a sectional view taken along a convexity warp 7' of the running assistance fabric of FIG. 1.

FIGS. 5 and 9 show sectional views of the convexity warp which is disposed on and under the warp forming the core fabric and woven with both the upper and lower convexity wefts. The convexity warps 3', 7' are disposed inside the core fabric side of the warps 2', 4', 6', 8', and woven with the convexity wefts other than the wefts woven with the warps 2', 4', 6', 8'. The warp fills in a convexity space, and has a function of preventing the convexity from sinking and enhancing the rigidity and strength of the fabric.

As described above, the convexity warp disposed outside among the warps for the convexity is woven with the upper convexity weft or the lower convexity weft, the convexity warp disposed inside is woven with both the upper and lower convexity wefts, and these structures are combined to form the multilayered fabric as a preferable running assistance fabric. Moreover, even in the structure in which the convexity warp woven with both the wefts for the upper and lower convexities disposed inside is woven with the upper convexity weft or the lower convexity weft, the similar effect can be obtained. Since the warps are disposed in multiple layers, the fabric is superior in strength and rigidity, and a sufficient convexity shape can be formed.

In the present example, the upper and lower convexities form a symmetric convexity shape in a vertical direction of the core fabric 100 and with respect to a center of the convexity, but this is not limited, and the fabric design of the warps for the upper and lower convexities can appropriately be changed.

Example 2

As Example 2, FIG. 11 shows a sectional view of a fabric of Example 2, and FIG. 12 shows a fabric design diagram of FIG. 11.

Similarly as Example 1, for the fabric of FIG. 12, the warps constituting the fabric include the warp which forms the core fabric 100 and the warp which forms the convexity. The warp forming the convexity is further divided into three warps for the convexity. Since three convexity warps are used to form the multilayered structure, the strength and rigidity are enhanced. Moreover, the upper and lower convexity warps are woven with the wefts of the core fabric in the vicinity of substantially a center portion of the upper and lower convexities formed in the core fabric, the woven portion for holding a posture is thus disposed, and the stable fabric having little deviation is obtained.

In FIG. 12, the yarns in the warp direction include the core fabric forming warps 1', 5', the upper convexity warps 2', 6', the convexity warps 3', 7', and the convexity warps 4', 8'. The core fabric forming wefts are 1, 2, 5, 8, 10, 12, 13, 14, 16, 18, 21, 24, 25, 28, 31, 33, 35, 36, 37, 39, 41 and 44, and the convexity wefts are 3, 4, 6, 7, 9, 11, 15, 17, 19, 20, 22, 23, 26, 27, 29, 30, 32, 34, 38, 40, 42, 43, 45 and 46.

Figure 13:
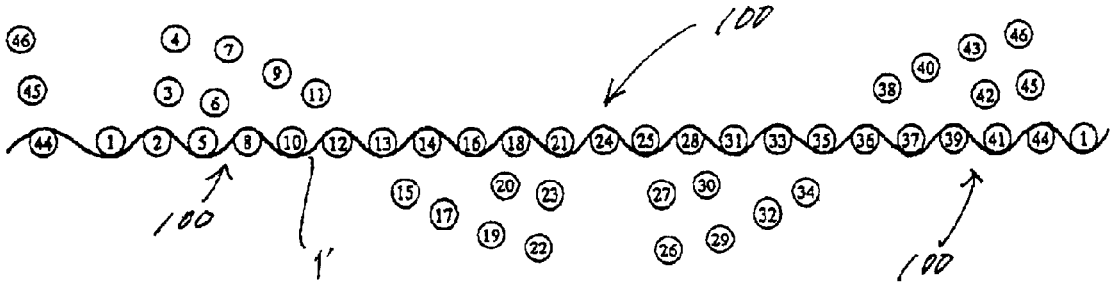
FIG. 13 is a sectional view taken along the core fabric forming warp 1' of the running assistance fabric of FIG. 11.
Figure 17:
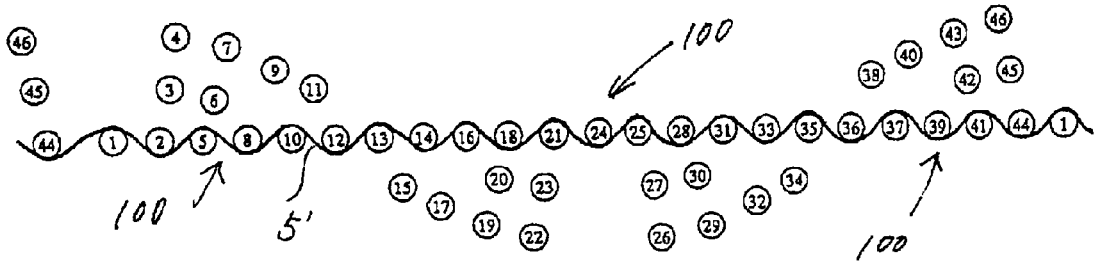
FIG. 17 is a sectional view taken along the core fabric forming warp 5' of the running assistance fabric of FIG. 11.

FIGS. 13 and 17 show the sectional fabric design of the core fabric forming warps. Similarly as Example 1, two core fabric warps 1", 5' vertically changed in one cycle in the plain weave fabric design are disposed.

Figure 14:
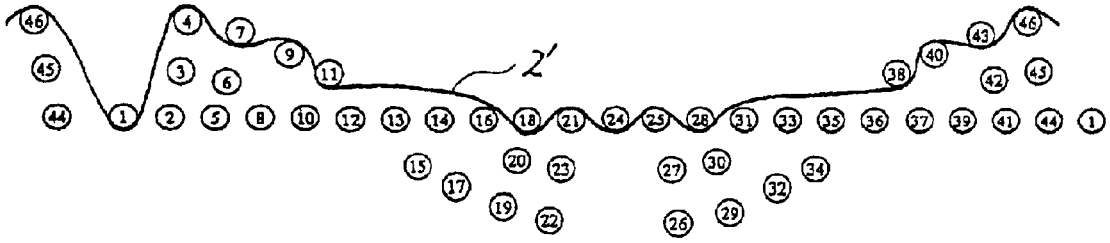
FIG. 14 is a sectional view taken along the convexity warp 2' of the running assistance fabric of FIG. 11.
Figure 18:
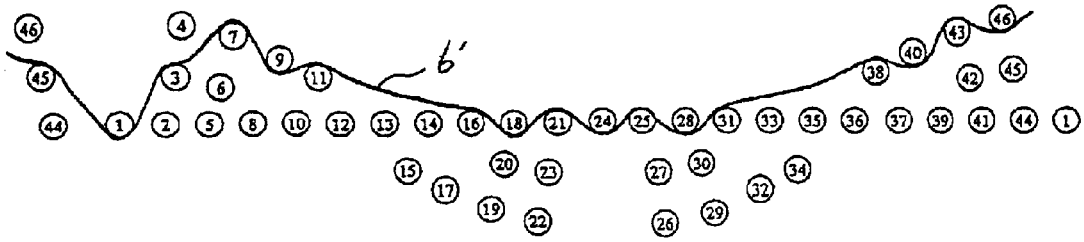
FIG. 18 is a sectional view taken along the convexity warp 6' of the running assistance fabric of FIG. 11.

FIGS. 14 and 18 show the sectional fabric design of the convexity warp. The convexity warps 2', 6' shown in FIGS. 14 and 18 are woven with the upper convexity weft disposed on the core fabric forming weft, and further woven with several core fabric forming wefts between the warps 1' 5', that form the core fabric 100, to form the woven portion for forming the convexity. Moreover, the upper and lower convexity warps are woven with the weft of the core fabric 100 in substantially the central portion of the upper and lower convexities formed in the core fabric and the woven portion for holding a posture of the convexity is disposed. Since the woven portion for holding a posture of the convexity is disposed, the deviation of the fabric is reduced, and the stability is much enhanced.

Figure 16:
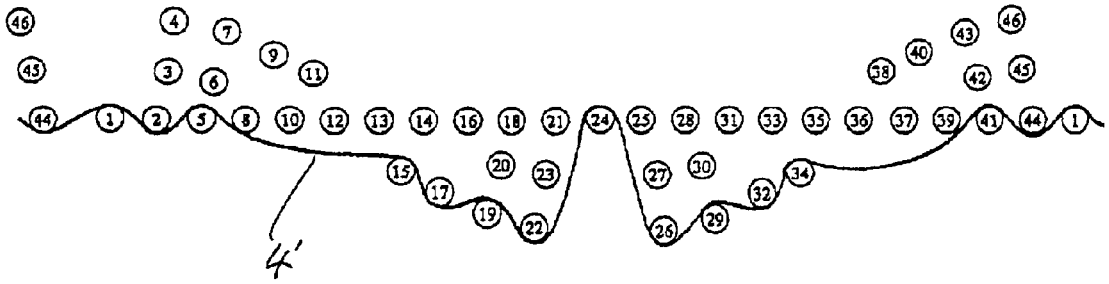
FIG. 16 is a sectional view taken along the convexity warp 4' of the running assistance fabric of FIG. 11.
Figure 20:
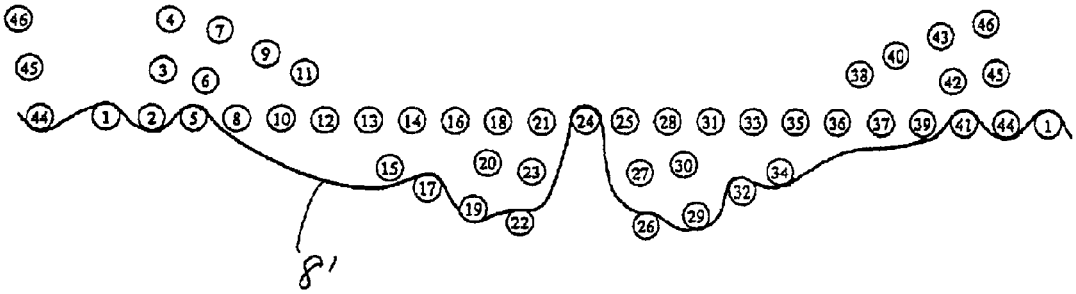
FIG. 20 is a sectional view taken along the convexity warp 8' of the running assistance fabric of FIG. 11.

In FIGS. 16 and 20, the lower convexity warps 4', 8' are woven with the lower convexity weft disposed under the core fabric forming weft, and the upper and lower convexity warps are woven with the core fabric forming wefts in substantially the central portion of the upper and lower convexities formed in the core fabric so that the woven portion for holding a posture of the convexity is disposed.

Figure 15:
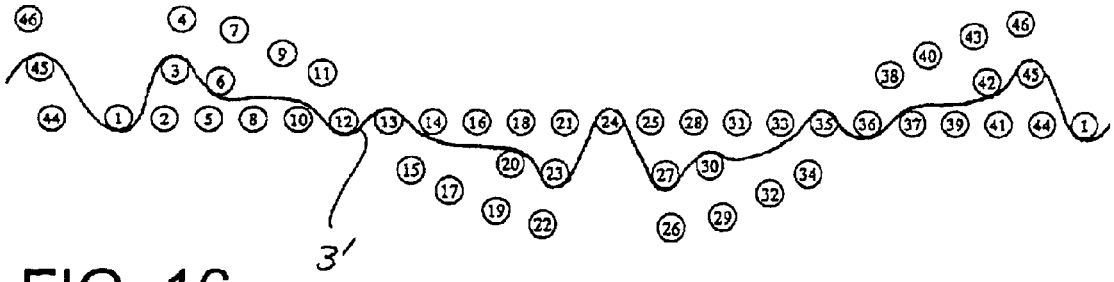
FIG. 15 is a sectional view taken along the convexity warp 3' of the running assistance fabric of FIG. 11.
Figure 19:
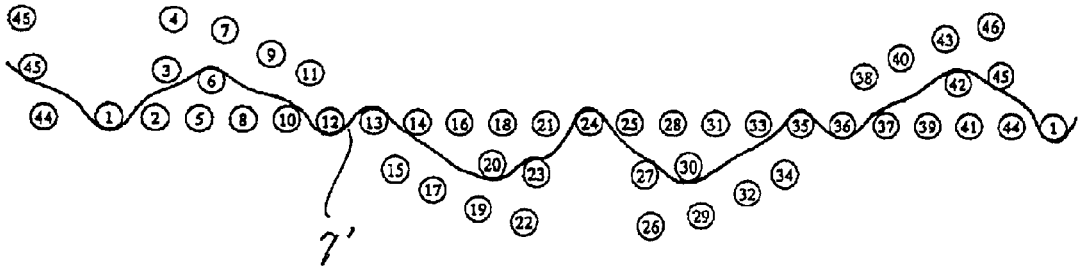
FIG. 19 is a sectional view taken along the convexity warp 7' of the running assistance fabric of FIG. 11.

The convexity warps shown in FIGS. 15 and 19 are disposed inside other convexity warps, and in FIGS. 15 and 19, the convexity warps 3', 7' are woven with both the upper and lower convexity wefts. Moreover, the similar the woven portion for holding a posture of the convexity is disposed in the same position as that of the woven portion for holding a posture of the convexity formed by weaving other convexity warps with the core fabric forming wefts. In FIGS. 15 and 19, the convexity warps 3', 7' are woven with the upper convexity wefts 3, 6, 42, 45 over the core fabric, and with the convexity wefts 20, 23, 27, 30 under the core fabric. Moreover, the woven portion for holding a posture is a portion formed by weaving the convexity warps 3', 7' with the core fabric forming wefts 1, 24.

As described above, when the convexity wefts are disposed in multiple layers, the fabric strength and rigidity can be enhanced. Moreover, the upper and lower convexity warps are woven with the core fabric forming wefts in the vicinity of substantially the middle portion of the convexities vertically formed in the core fabric and the woven portion for holding a posture of the weaving is disposed, so that the yarn deviation is eliminated, and the stability and rigidity of the fabric can be enhanced.

The present invention provides a fabric which entirely has a sufficient rigidity and slip resistance, and a preferable fabric for the running/escaping of a vehicle, or for preventing slippage in a place where sand, mud, gravel, snow, and the like are present. The fabric is constituted by weaving yarns and therefore produces a superior effect that the fabric is lightweight, can be wound up, can be spread in a target unleveled ground in a short time, and can thus easily be handled.

The disclosure of Japanese Patent Application No. 2001-77198 filed Feb. 13, 2001 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A vehicle running assistance fabric having a convexity by a woven structure comprising: a core fabric which is formed by weaving a core fabric forming warp and a core fabric forming weft wherein the core fabric has a single warp thickness and a single weft thickness; and an upper convexity warp which is disposed over the core fabric forming warp and is woven with an upper convexity weft disposed on the core fabric forming weft and/or a lower convexity warp which is disposed under the core fabric forming warp and is woven with a lower convexity weft disposed under the core fabric forming weft, to form a convexity; wherein the upper or lower convexity warp is woven with one or plurality of the core fabric forming wefts to form a woven portion.

2. The vehicle running assistance fabric according to claim 1, the upper convexity warp disposed over the core fabric forming warp is woven with the upper convexity weft disposed on the core fabric forming weft to form an upper convexity, and/or the lower convexity warp disposed under the core fabric forming warp is woven with the lower convexity weft disposed under the core fabric forming weft to form a lower convexity, respectively; the upper and lower convexity warps are woven with the one or plurality of core fabric forming wefts to form the woven portion; the upper convexity and the lower convexity are displaced and arranged at different positions of the core fabric.

3. The vehicle running assistance fabric according to claim 1 or 2, wherein the upper convexity warp or the lower convexity warp is disposed over or under the core fabric forming warp, and is a single layer warp woven with both the upper convexity weft and the lower convexity weft.

4. The vehicle running assistance fabric according to claim 1 or 2, wherein the upper convexity warp is woven with the upper convexity weft disposed on the core fabric forming weft and partially with the core fabric forming weft, and the lower convexity warp is woven with the lower convexity weft disposed under the core fabric forming weft and partially with the core fabric forming weft.

5. The vehicle running assistance fabric according to claim 1 or 2, wherein an outermost disposed warp among a plurality of warps for the upper and lower convexities is woven with the upper convexity weft or the lower convexity weft and the core fabric forming weft, and at least one of the warps arranged inside the outermost disposed warp is woven with the upper convexity weft, the lower convexity weft and the core fabric forming weft.

6. The vehicle running assistance fabric according to claim 1 or 2, wherein an outermost disposed warp among a plurality of warps for the upper and lower convexities is woven with the upper convexity weft or the lower convexity weft, and the warp disposed inside the outermost disposed warp is woven with one of the upper convexity weft and the lower convexity weft.

7. The vehicle running assistance fabric according to claim 1 or 2, wherein the warps for the upper and lower convexities are woven with the one or plurality of wefts of the core fabric in the vicinity of a substantially middle portion between the convexities formed on and under the core fabric to form a woven portion for holding a posture of the convexity.

8. The vehicle running assistance fabric according to claim 7, wherein the woven portion for holding the posture is formed by weaving the plurality of warps of the substantially middle portion of the convexity with the one or plurality of core fabric forming wefts.

9. The vehicle running assistance fabric according to claim 1, wherein the core fabric has a plain weave in which the core fabric forming warp alternatively passes over and under the core fabric forming wefts.

10. The vehicle running assistance fabric according to claim 1, wherein the core fabric has rigidity.

* * * * *